United States Patent [19]

Passamaneck et al.

[11] Patent Number: 4,907,800

[45] Date of Patent: Mar. 13, 1990

[54] BAT SWING PRACTICE APPARATUS

[76] Inventors: Richard S. Passamaneck, 5150 S. Oak St., Littleton, Colo. 80127; Larry G. Nelson, 421 Oakmont Cir., Marietta, Ga. 30067

[21] Appl. No.: 101,248

[22] Filed: Sep. 24, 1987

[51] Int. Cl.[4] ..... A63B 69/40

[52] U.S. Cl. ..... 273/26 B; 446/218; 446/266; 272/116

[58] Field of Search ..... 272/139, 116, 130, 131, 272/117, 46, 70.3, 128, 143, 902, 96, 94; 273/26 B, 26 R, 194; D21/93; 446/266, 236, 240, 241, 217, 218, 237

[56] References Cited

U.S. PATENT DOCUMENTS

| | | | |
|---|---|---|---|
| 3,675,364 | 7/1972 | Halpern | 446/218 |
| 3,809,397 | 5/1974 | Gruenewald | 273/26 B |
| 4,411,422 | 10/1983 | Solloway | 272/116 |
| 4,416,451 | 11/1983 | Solloway | 272/116 |
| 4,468,023 | 8/1984 | Salloway | 272/94 |
| 4,565,369 | 1/1986 | Bedgood | 272/143 |
| 4,582,497 | 4/1986 | Lyons | 446/266 |

*Primary Examiner*—T. Brown

*Attorney, Agent, or Firm*—Foley & Lardner, Schwartz, Jeffery, Schwaab, Mack, Blumenthal & Evans

[57] ABSTRACT

The training aid has a handle with a fan section at its far end. The fan section provides resistance to swinging the handle. The fan section has a rotatable fan and a friction element which varies the rotational resistance of the fan.

16 Claims, 5 Drawing Sheets

38
40
42
44
50
52
26'
62"
60
89
90
92
94
96
97
98
99
100
101
103
105

BAT SWING PRACTICE APPARATUS

BACKGROUND OF THE INVENTION

1. Field of the Invention

The present invention relates to devices for improving ones ability to play a particular sport, and more particularly to devices to improve ones ability to play baseball, golf and other sports which involve the swinging of a club.

2. Discussion of the Related Art

Baseball and golf, among other sports which involve swinging a club, require the development of specific muscles to facilitate the swinging movement. It is well known, for example, that, when a batter is awaiting a turn at bat, he or she will prepare by swinging a weighted bat so that the actual bat will seem light and easier to swing. A weighted bat, however, has disadvantages since it is actually the inertia of the bat which must be overcome and increasing the downward force of the bat due to gravity results in the development of muscles which are not actually needed for a proper swing and which may actually be detrimental to the swing.

Attempts have been made to provide bat training aids and the like. For example, U.S. Pat. No. 3,463,492 to White discloses a baseball bat training device which has a bat shaped handle and fixed fins at the end of the handle.

U.S. Pat. No. 3,809,397 to Gruenewald shows another baseball bat training aid which has a bat shaped handle with fixed fins at the end.

U.S. Pat. No. 3,820,785 to Occhipinti et al shows a tennis training aid which is in the form of a tennis racquet having a cover over most of the strings of the racquet to increase the swinging resistance of the racquet.

None of the foregoing devices provides the high level of resistance necessary to ensure an improved swing.

SUMMARY OF THE INVENTION

One object of the present invention is to provide a training aid which will improve the ability of a player to swing a baseball bat, golf club or other athletic implement.

Another object of the present invention is to provide a training aid which is simple to use and does not provide a significant increase in weight over the actual device to be used in the subject sport.

A further object of the present invention is to provide a training aid which can be adapted for use in a variety of sports.

Another object of the present invention is to provide a training aid which is relatively easy to manufacture yet is effective and durable in use.

In accordance with the above and other objects, the present invention comprises a fan having a plurality of fan blades, a housing mounting the fan for rotation relative thereto, an elongated handle attached to the housing to permit a subject to swing the housing such that the fan rotates by relative motion between the fan and ambient to produce a resistance to the swinging and provide exercise to the subject, and a mechanism for adjusting rotational resistance of the fan such that the amount of exercise obtained by swinging the handle can be adjusted.

In accordance with other objects of the invention, the fan is attached to a shaft and the adjusting mechanism comprises a first bearing mounting one side of the shaft and a second bearing mounting a second side of the shaft, the first bearing having a greater resistance to rotation than the second bearing such that the resistance of the fan to rotation varies depending on the direction in which the handle is swung.

In order to provide the varying resistance, one of the bearings may be tapered and one of the bearings may be flat.

In accordance with other objects of the invention, the adjusting mechanism may comprise a movable pad for applying an adjustable rotating friction to the fan.

The fan may be mounted to a shaft and the adjusting mechanism may comprise an adjustable diameter bearing mounting the shaft.

The handle may have the shape of a baseball bat, a golf club, or other athletic implement.

The housing may have two opposed openings and the fan is positioned in the housing such that when the handle is swung in one direction air enters one opening and forces the fan against one of the bearings, and when the handle is swung in an opposite direction, air enters the other opening and the fan is forced against the other of the bearings.

BRIEF DESCRIPTION OF THE DRAWINGS

The above and other objects of the invention will become more readily apparent as the invention becomes more fully understood from the detailed description to follow, reference being had to the accompanying drawings in which like numerals represent like parts throughout, and in which.

DETAILED DESCRIPTION OF THE PREFERRED EMBODIMENTS

Figure 1:
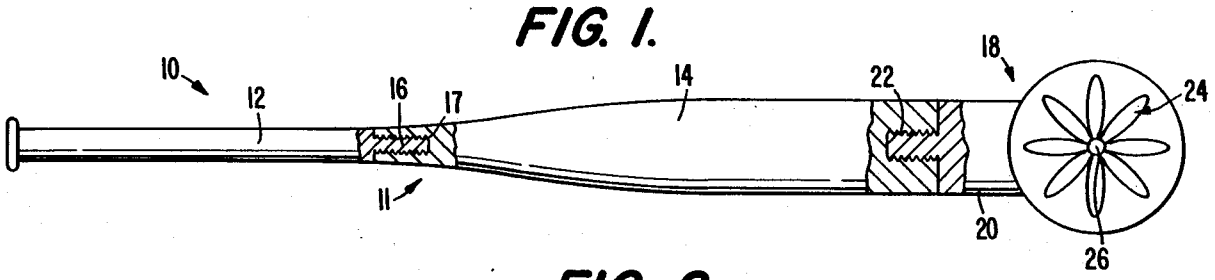
FIG. 1 is an elevational, sectional view of the training aid of the present invention.
Figure 2:
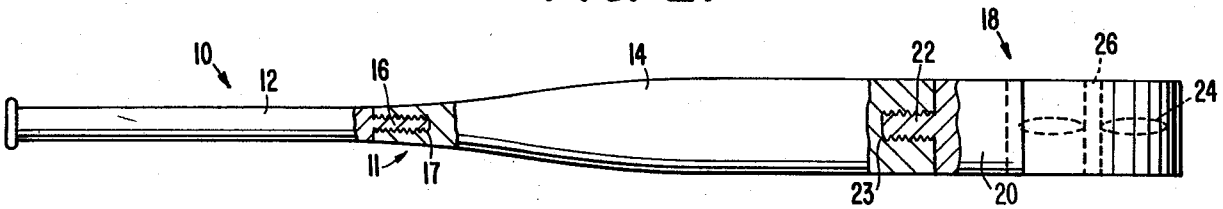
FIG. 2 is a top plan sectional view of the training aid of the present invention.

FIGS. 1 and 2 show the basic configuration of the training aid 10 of the present invention which includes a handle shown generally at 11 having an end part 12 which can be manufactured in different lengths to accommodate different bat length requirements, and a barrel 14 which may be a constant length of, for example, 16 inches. The handle end part 12 and the barrel may be connected by a screw 16 attached to the end part 12 and a threaded hole 17 formed in the barrel. A fan section 18, which has a shroud section 20, connects to the barrel 14 through a screw 22 and a threaded hole 23. The housing 20 mounts a fan 24 through a fan shaft 26. The shroud 20 is symmetrical and open on opposite sides so that, when the handle 11 is swung, air passes through the shroud and causes the fan 24 to rotate.

Figure 3:
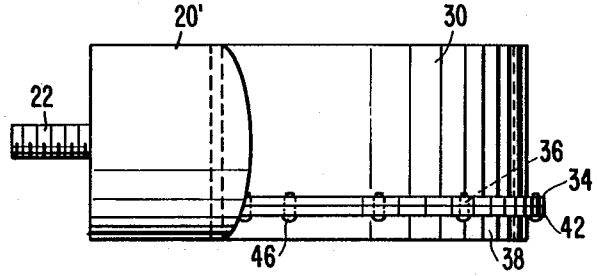
FIG. 3 is a detailed top plan view of one embodiment of the fan housing for use in the training aid of FIG. 1.
Figure 5:
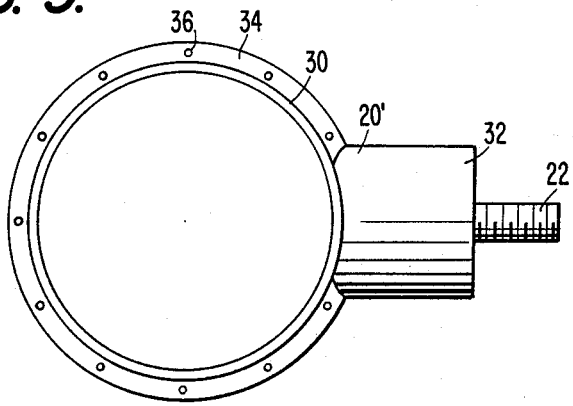
FIG. 5 is a side elevational view of the fan housing of FIG. 2.
Figures 10, 11, 12:
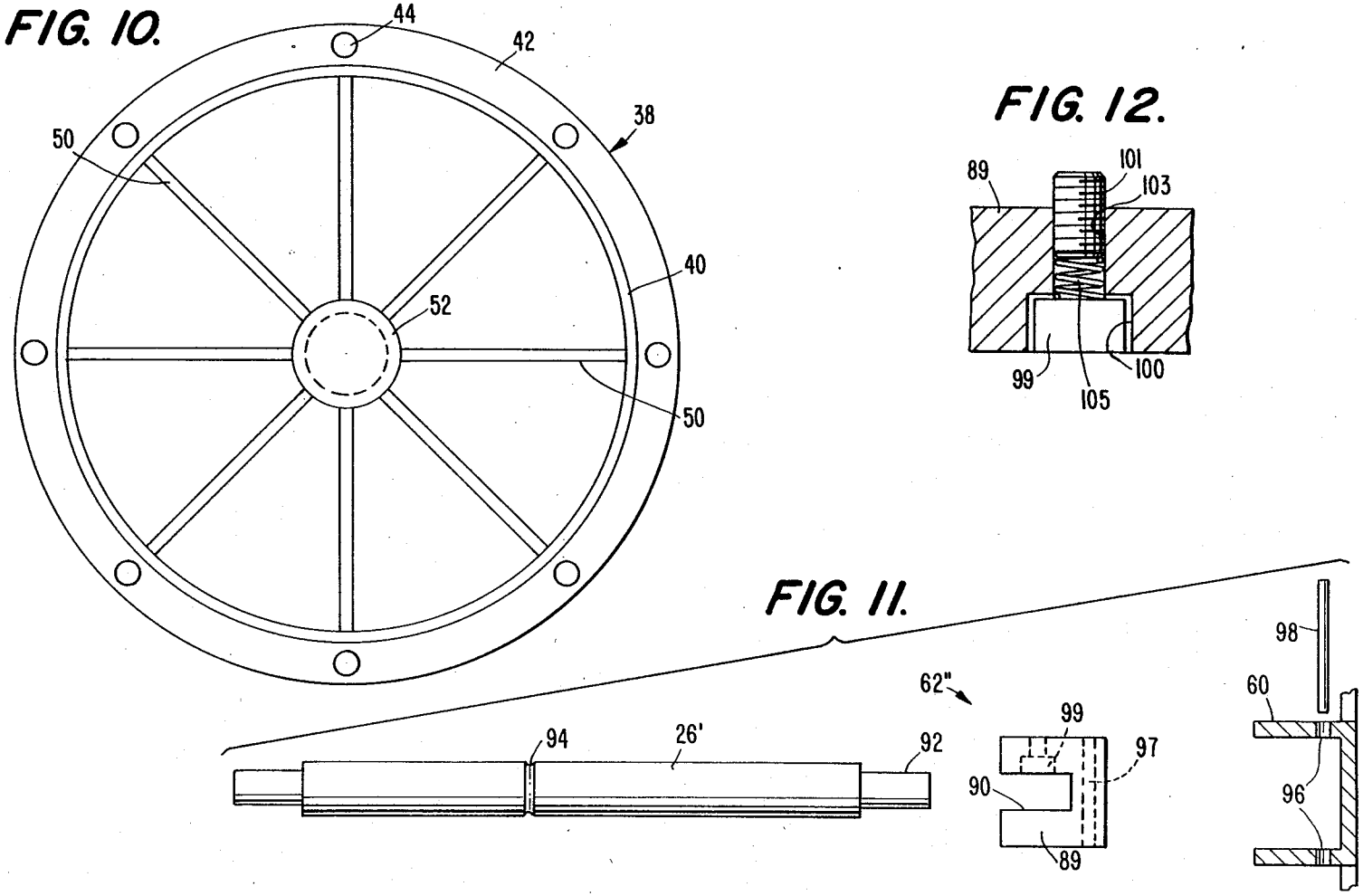
FIG. 10 is a detailed side elevational view of the cap used on the housing of FIG. 5.
FIG. 11 is an exploded view of the fan shaft with an adjustable tension bearing according to the present invention.
FIG. 12 is an enlarged view showing the adjustable tension bearing according to the present invention.

FIGS. 3, 5 and 10 show one type of shroud 20′ which can be used in the present invention. Shroud 20′ has a cylindrical outer shell 30 attached to a mounting portion 32 which mounts a screw 22 which engages mating screw threads in the handle 11. A mounting flange 34 extends radially outward from the cylindrical shroud 30 and has threaded holes 36. An end cover 38 includes a cylindrical lip 40 and a radially extending mounting flange 42 having openings 44 through which attaching screws 46 pass to connect the cover 38 to the shell 30. Ribs 50 extend radially inward from the lip 40 and support a bearing support plate 52 in the center of the opening defined by the cylindrical lip 40. Similar ribs and a similar bearing support plate are attached to a similar opening on the opposite side of shell 30. The cover 38 is removable to enable access to the fan inside the shroud for repair or replacement. By making the cover completely removable, there is no binding between the bearing, which is mounted on the cover, as will be discussed below, and the fan shaft.

Figure 6:
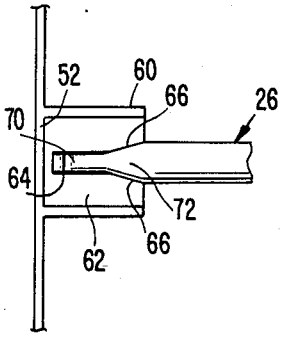
FIG. 6 is a schematic view of one form of bearing for use with the present invention.
Figure 7:
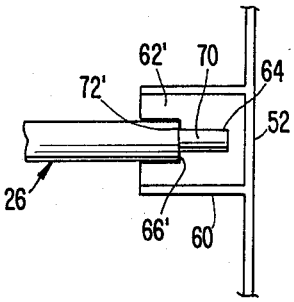
FIG. 7 is a schematic view of a second form of bearing for use with the present invention.

FIGS. 6 and 7 show two bearings which can be used to mount a fan in the shroud 20. FIG. 6 shows the bearing support plate 52 which is part of a bearing cup 60. Bearing cup 60 receives a bearing 62 which has a blind hole 64 and a frustum shaped front opening 66. The fan shaft 26 is supported in the bearing 62 and has a cylindrical journal portion 70 which is received in the blind hole 64 as well as a conical portion 72 which mates with the frustum shaped journal 66. The bearing 62 is designed so that the friction against shaft 26 increases as the speed of the shaft 26 increases. Also, as is apparent from the shape of the bearing, if a force is applied to the shaft 26 toward the bearing 62, the portion where the frustum shaped journal of the 10 bearing meets the conical portion of the shaft causes the friction to increase as the force increases. The amount of the increase in force depends on the angle of the frustum-shaped journal and can be adjusted at the time of manufacture.

FIG. 7 shows another bearing 62′ which can be used in the present invention. This bearing 62′ is similar to bearing 62 except that there is a flat journal section 66′ instead of the frustum shaped journal section of the bearing 62. Accordingly, if a force is applied to the shaft 26 in the direction of bearing 62′, there will be less of an increase in friction than if there is a force applied to the shaft in the direction of the bearing 62. As mentioned above, the amount of force produced by the frustum shaped bearing 62 can be modified as desired by changing the angle of the frustum shaped journal. With the flat bearing journal of bearing 62′, the amount of force is not adjustable since there is not similar angle. As with bearing 62, however, there will be an increase in friction against the shaft 26 in bearing 62′ with an increase in speed.

Fan 24 can be mounted on shaft 26 and bearing 62 can be mounted in a bearing cup on one side of the fan section 18 with the bearing 62′ mounted on the other side of the fan section 18. In this manner, when the handle 11 is swung in a direction in which the bearing 62 faces, there will be less force on the fan than if the handle 11 is swung in the direction in which the bearing 62′ faces. Thus, the amount of force on the fan can be adjusted to increase or decrease the force by simply changing the direction in which the handle 11 is swung. That is, if the bat is swung in one direction, a greater resistance to the swing is felt than if the bat is swung in the other direction.

Figure 4:
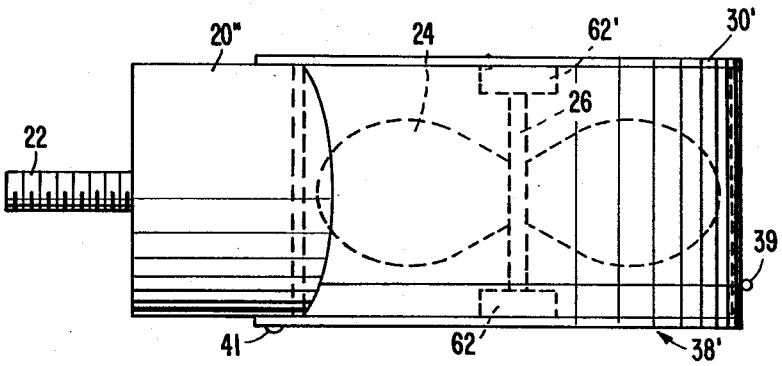
FIG. 4 is a detailed top plan sectional view of a second embodiment of the fan housing for use in the training aid of FIG. 2.

FIG. 4 shows an alternate fan section which can be used with the present invention. The fan section in FIG. 4 is similar to that in FIG. 3 except that the FIG. 4 fan section includes a hinged cover 38′ over a shroud 30′. Cover 38′ is attached by hinge 39 at one end and attached by a screw 41 at the opposite end to the shroud 30′. In this manner, the cover 38′ can be swung open for inspection of the fan or for repair and replacement of the fan. Bearings similar to those shown in FIGS. 6 and 7 would be used on opposite sides of the fan section of FIG. 4. It will be understood that a plurality of screws 41 can be spaced around the cover 38′ to hold it in place. The hinged cover has the disadvantage that the swinging movement of the cover may interfere with the meshing of the bearing on the cover and the fan shaft.

Figure 8:
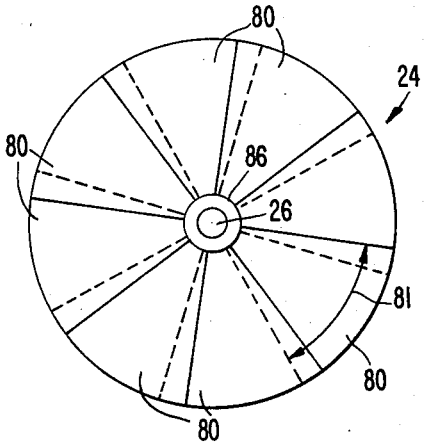
FIG. 8 is a schematic view showing the overlapping blades of the fan used in the present invention.
Figure 9:
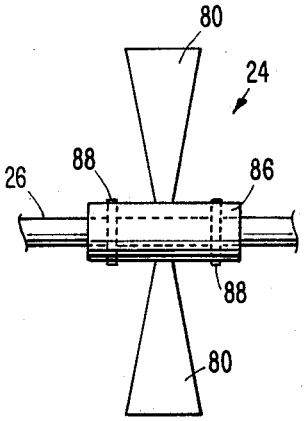
FIG. 9 is a front elevational view showing the fan of FIG. 8.

FIGS. 8 and 9 show a fan which can be used in the present invention. As can be seen in these figures, the fan 24 has eight blades 80 which overlap one another by 25% to provide a large resistance to air movement through the shroud in which the fan is mounted. The extent of one blade 80 is indicated by the double headed arrow 81. Each blade has a pitch of about 30 degrees and the blades are attached to a hub 86 through which the shaft 26 is received. The hub 86 is connected to the shaft by pins 88 which extend through the hub 86 and the shaft 26, or by set screws or any other convenient attachment mechanism.

FIGS. 11 and 12 show an alternate bearing construction in which the bearing friction is infinitely adjustable. This bearing 62″ is mounted in the same type of bearing cup 60 as previously mentioned bearings 62 and 62′ Bearing 62″ has a bearing block 89 with a single blind opening 90 which receives a reduced diameter end 92 of a shaft 26′. The ends of shaft 26′ are identical and a bearing 62″ is provided on each end.

It will also be noted that the shaft 26′ has a groove 94 to receive a set screw to locate and secure a fan 24, as discussed above.

The bearing cup 60 has a pair of aligned openings 96 on opposite sides. These openings align with an opening 97 in the bearing 62″ and receive a pin 98 which holds the bearing 62″ in place in the bearing cup 60 to keep the bearing from rotating with the shaft 26′. The pin 98 may be force fit and held in by friction or may be a cotter pin which is bent after insertion. Clearly, such a pin can be used with any of the bearings discussed above for the same purpose.

An important feature of the bearing 62″ is an adjustable pressure pad 99 which is shown most clearly in FIG. 12. The pad 99 is received in a recess 100 in the bearing block 89 and is able to protrude into the hole 90 to make contact with the shaft 26'. In this manner, the amount of friction against the shaft is controlled by the force of the pad 99 against the shaft 26'. this force is controlled by a set screw 101 which is received in a threaded hole 103 in the bearing block 89. A spring 105 is disposed between the set screw 101 and the pad 99 so that, as the set screw 101 is moved toward the pad 99, the spring 105 is compressed and the force of the pad on the shaft is increased. With this arrangement, the user can adjust the resistance of the training aid against a swinging movement by adjusting the amount of resistance of the bearings against the turning of the fan.

It will be understood from the foregoing that the present invention is used by an athlete by holding the handle and swinging the training aid as if it were an actual sporting implement. In the case of the training aid of FIG. 1, the actual sporting implement would, of course, be a baseball bat. The swinging movement is resisted by the rotation of the fan 24 which resists the passage of air through the fan shroud. The amount of resistance is determined by the size of the fan, the number of blades and the amount of friction produced by the fan bearings. As discussed above, the bearing friction can be adjusted to suit different athletes and different sports. Constant swinging of the training aid against resistance builds the strength of the muscles required for the subject to become more proficient at a particular athletic activity.

Figure 13:
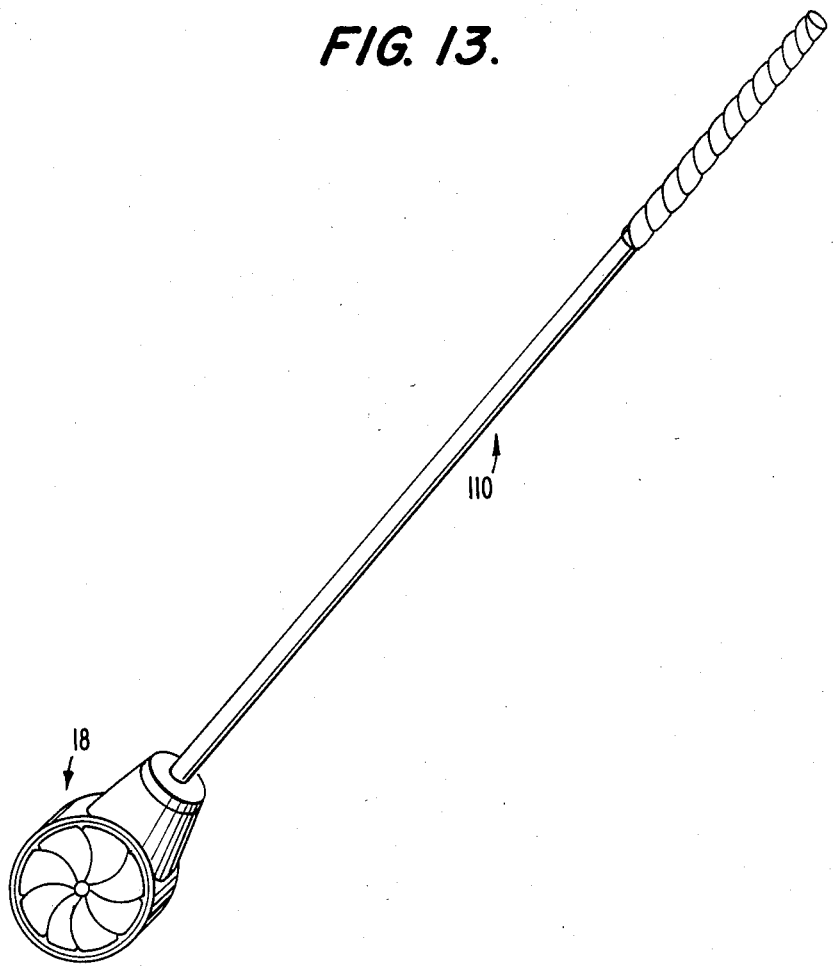
FIG. 13 is a schematic view showing an embodiment of the invention for use as a golf training aid.

FIG. 13 shows an embodiment of the invention for use as a golf training aid. The golf training aid has a fan section 18 which is the same as the fan section 18 of the baseball bat training aid 10. Attached to the fan section 18 is a golf club handle 112. The golf club training aid is swung like a golf club and the fan section provides resistance to build the muscles necessary for a proper golf swing.

The present invention can be used to provide other training aids. For example, a tennis training aid can be produced by attaching a tennis handle to the fan section 18.

The main components of the present invention can be produced from aluminum, steel, plastic or any other suitable material. The fan blades are preferably made of an acrylic plastic and mounted on an aluminum shaft. The bearings are preferably made of acrylic plastic, as is the pressure adjustment pad 99.

The dimensions of the invention should be those of the actual sports implement being replaced for practice. For the bat of FIGS. 1 and 2, the overall length should be about 33 to 34 inches on the average and 30 to 36 inches in the extreme. The bat should weigh about 32 oz on the average and 30 to 35 oz in the extreme. The handle end should be about three quarters of an inch in thickness whereas the barrel should be about two and three quarters inches thick. The fan shaft should be about 5 inches in length and the fan shroud should be about 4 inches in diameter.

Figure 14:
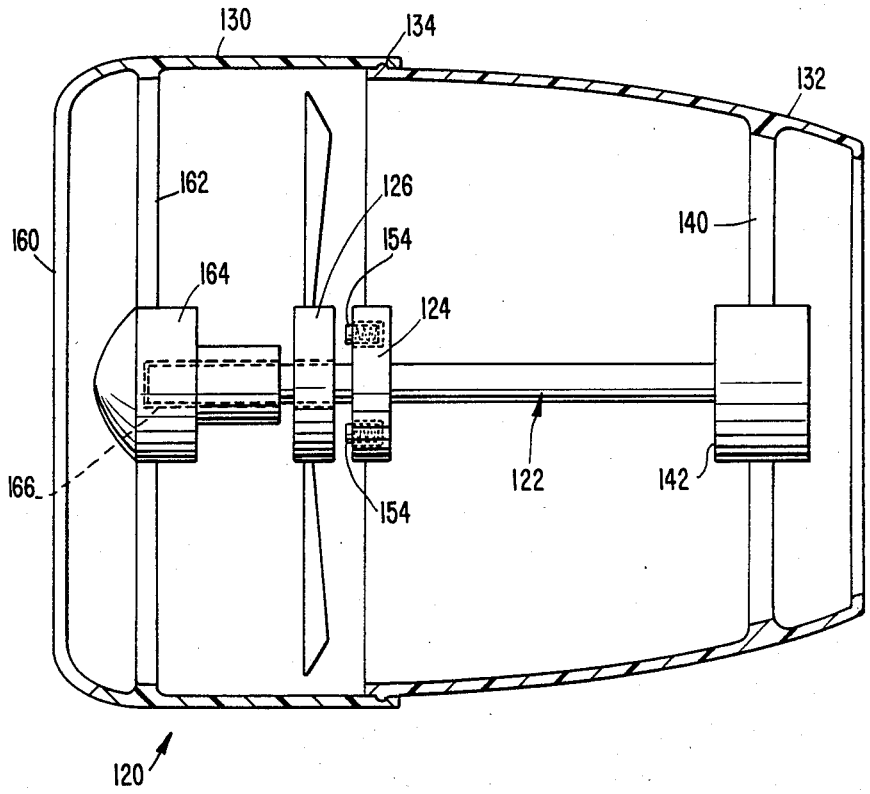
FIG. 14 is a longitudinal cross section of an alternate variable resistance fan and housing according to the present invention.
Figure 15:
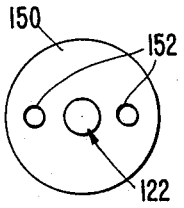
FIG. 15 is an end view of the variable resistance element of FIG. 14.
Figure 16:
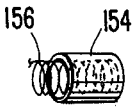
FIG. 16 is a perspective view of a resistance plug used in the variable resistance element of FIG. 15.

FIG. 14 shows an alternate embodiment of a variable resistance fan to be used with a golf club trainer, baseball bat trainer, or the like. The device of FIG. 14 includes a two-piece housing 120 which mounts a fixed shaft 122. Integral with the shaft 122 is a variable resistance element 124. A fan 126 is rotatably mounted on shaft 122.

The housing 120 contains a front housing member 130 and a rear housing member 132. Both housing members are formed of synthetic resin and can be injection molded or the like. The front housing member 130 overlaps the rear housing member 132 at a connection 134. The housing members may be snap fit together or connected by any other suitable means. Preferably, the connection should be separable to enable a user to replace or adjust the fan 126.

Molded integrally with the rear housing member 132 is a support strut 140 which has an enlarged central section 142. The shaft 122 extends forwardly from enlarged section 142. Preferably, the housing member 132, support 140, enlarged section 142 and the shaft 122 are molded integrally as a single unit.

The resistance element 124 is shown in FIG. 5 to comprise a disk member 150 which is molded integrally with shaft 122. A pair of blind holes 152 are formed on diametrically opposed sides of the disk member 150. A hollow cap 154 receives a spring 156. A similar cap 154 with a spring 156 is mounted in each of the holes 152.

The fan 126 is molded as a single unit and may have as few as two fan blades. The fan 126 is rotatably mounted on shaft 122 and is axially slidable therealong. Clearly, with reference to FIG. 14, it can be seen that, as the housing 120 is moved forwardly, air resistance will cause the fan 126 to rotate and to move backward on shaft 122 against the spring loaded caps 154. The greater the forward motion, the greater the force with which the fan 126 is pressed against caps 154. This increases the resistance to rotation of the fan and increases the resistance to forward motion of the housing 120. In this manner, the resistance to forward movement of the housing 120 increases as the speed of the forward movement increases, just as with the embodiments of the invention discussed above.

The front housing portion 130 is formed with a circular opening 160 and a rib 162 which mounts an enlarged forward axle support 164. Axle support 164 has an opening 166 which receives the front end of axle 122. The axle support 164 also acts as a forward stop for fan 126. If desired, the enlarged portion 164 could be enlarged even more and a pair of spring loaded caps 154 could be mounted therein to provide forward resistance for fan 126 in the event that it is desired to swing the housing 120 backwards.

The foregoing description of the invention is intended to illustrate the invention but is not intended to be limitative thereof. Clearly numerous additions, substitutions and other changes can be made without departing from the scope of the invention as set forth in the appended claims.

What is claimed is:

1. A device, comprising:

a fan having a plurality of fan blades;

a housing mounting said fan for rotation relative thereto;

an elongated handle attached to said housing to permit a subject to swing said housing such that said fan rotates by relative motion between said fan and ambient to produce a resistance to said swinging and provide exercise to said subject; and means for adjusting rotational resistance of said fan such that the amount of exercise obtained by swinging said handle can be adjusted.

2. A device as claimed in claim 1 wherein said fan is attached to a shaft and said adjusting means comprises a first bearing mounting one side of said shaft and a second bearing mounting a second side of said shaft, said first bearing having a greater resistance to rotation than said second bearing such that the resistance of said fan to rotation varies depending on the direction in which said handle is swung.

3. A device as claimed in claim 2 wherein said housing has two opposed openings and said fan is positioned in said housing such that when said handle is swung in one direction air enters one opening and forces said fan against one of said bearings, and when said handle is swung in an opposite direction, air enters the other opening and the fan is forced against the other of said bearings.

4. A device as claimed in claim 1 wherein one of said bearings is tapered.

5. A device as claimed in claim 1 wherein said adjusting means comprises a movable pad for applying an adjustable rotating friction to said fan.

6. A device as claimed in claim 1 wherein said fan is mounted to a shaft and said adjusting means comprises an adjustable diameter bearing mounting said shaft.

7. A device as claimed in claim 1 wherein handle has the shape of a baseball bat.

8. A device as claimed in claim 1 wherein said handle has the shape of a golf club.

9. A device as claimed in claim 1 wherein said housing is cylindrical.

10. A device as claimed in claim 1 wherein said fan has overlapping fan blades.

11. A device as claimed in claim 1 wherein said handle is at least 20 inches in length.

12. A device as claimed in claim 11 wherein said handle weighs at least 20 ounces.

13. A device as claimed in claim 1 wherein said handle is divided into two sections which screw together.

14. A device as claimed in claim 1 wherein said mounting includes a shaft, a bearing receiving said shaft, and a bearing cap receiving said bearing said bearing cap being attached to said housing.

15. A device as claimed in claim 1 wherein said means for adjusting rotational resistance of said fan comprises means for abutting against said fan with a variable force.

16. A device as claimed in claim 15 wherein said fan is mounted on an axle for rotational movement and axial movement along said axle and wherein said means for abutting against said fan comprises a member mounted to said fan and mounting at least one spring loaded member biased into contact with said fan such that axial movement of said fan towards said spring loaded member increases rotational resistance to said fan.

* * * * *